US007423000B2

(12) United States Patent
Williamson et al.

(10) Patent No.: US 7,423,000 B2
(45) Date of Patent: Sep. 9, 2008

(54) NON-PHOSPHOROUS, NON-METALLIC ANTI-WEAR COMPOUND AND FRICTION MODIFIER

(75) Inventors: Will F. Williamson, Seattle, WA (US); Blaine Rhodes, Bellevue, WA (US)

(73) Assignee: International Lubricants, Inc., Seattle, WA (US)

( * ) Notice: Subject to any disclaimer, the term of this patent is extended or adjusted under 35 U.S.C. 154(b) by 0 days.

(21) Appl. No.: 09/299,068

(22) Filed: Apr. 23, 1999

(65) Prior Publication Data

US 2002/0072479 A1 Jun. 13, 2002

Related U.S. Application Data

(63) Continuation-in-part of application No. 09/234,019, filed on Jan. 19, 1999, now abandoned.

(51) Int. Cl.
*C10M 105/38* (2006.01)
*C10L 1/18* (2006.01)

(52) U.S. Cl. ..... 508/485; 44/386; 560/89

(58) Field of Classification Search ..... 508/485; 525/285, 301, 309, 320, 33.7, 384; 44/386; 560/89

See application file for complete search history.

(56) References Cited

U.S. PATENT DOCUMENTS

| | | | | | |
|---|---|---|---|---|---|
| 2,648,693 | A | | 8/1953 | Schmerling | 260/410.6 |
| 3,322,703 | A | * | 5/1967 | Lindemann | 260/8 |
| 4,066,789 | A | * | 1/1978 | Mores et al. | 424/365 |
| 4,144,178 | A | * | 3/1979 | Katabe et al. | |
| 4,479,883 | A | | 10/1984 | Shaub et al. | 252/32.7 |
| 4,486,573 | A | * | 12/1984 | Hayashi | 44/386 |
| 4,489,194 | A | * | 12/1984 | Hayashi | 508/485 |
| 4,509,955 | A | * | 4/1985 | Hayashi | 44/386 |
| 4,574,057 | A | * | 3/1986 | Kaza et al. | 526/283 |
| 4,589,990 | A | * | 5/1986 | Zehler et al. | 508/485 |
| RE32,174 | E | * | 6/1986 | LeSuer | 44/386 |
| 4,601,840 | A | * | 7/1986 | Zehler et al. | 508/485 |
| 4,696,869 | A | * | 9/1987 | Funahashi et al. | 252/62.54 |
| 5,021,173 | A | | 6/1991 | Waddoups et al. | 252/35 |
| 5,284,493 | A | * | 2/1994 | Baillargeon et al. | 560/88 |
| 5,284,494 | A | * | 2/1994 | Baillargeon et al. | 44/386 |
| 5,284,496 | A | * | 2/1994 | Baillargeon et al. | 44/386 |
| 5,304,316 | A | * | 4/1994 | Urushibata et al. | 252/60 |
| 5,378,249 | A | * | 1/1995 | Morrison | 508/485 |
| 5,411,672 | A | * | 5/1995 | Kagaya et al. | 508/485 |
| 5,432,209 | A | * | 7/1995 | Sobajima et al. | 525/89 |
| 5,614,483 | A | * | 3/1997 | Fessenbecker et al. | 508/550 |
| 5,833,722 | A | * | 11/1998 | Davies et al. | 44/418 |
| 5,852,089 | A | * | 12/1998 | Kawazura et al. | 524/308 |
| 5,858,028 | A | * | 1/1999 | Davies et al. | 44/393 |
| 5,880,072 | A | * | 3/1999 | Furey et al. | 508/263 |
| 5,985,806 | A | * | 11/1999 | O'Lenick, Jr. | 508/485 |
| 6,239,298 | B1 | * | 5/2001 | Williamson et al. | 554/117 |

FOREIGN PATENT DOCUMENTS

| | | |
|---|---|---|
| WO | WO 99/36492 | 7/1999 |
| WO | WO 99/61563 | 12/1999 |

* cited by examiner

*Primary Examiner*—Cephia D Toomer
(74) *Attorney, Agent, or Firm*—Barry L. Davison; Davis Wright Tremaine LLP

(57) ABSTRACT

There is disclosed a friction reducing compound, comprising an intermediate adduct of a first moiety reacted in a first reaction with a second moiety to form the intermediate adduct and further esterifying or amidafying the intermediate adduct with a third moiety in a molar ratio of from about 1:2 to about 2:1, wherein the first moiety is an unsaturated synthetic dieneophilic base oil, wherein the second moiety is a compound having a diene conjugated carbon-carbon double bond and a carboxylic acid moiety or anhydride group, wherein the first reaction comprises mixing the first moiety with the second moiety in a molar ratio of from about 1:2 to about 2:1 under an inert atmosphere; and wherein the third moiety is a polyhydroxy compound.

32 Claims, No Drawings

NON-PHOSPHOROUS, NON-METALLIC ANTI-WEAR COMPOUND AND FRICTION MODIFIER

CROSS-REFERENCE TO RELATED APPLICATION

This patent application is a continuation-in-part of U.S. patent application Ser. No. 09/234,019 filed Jan. 19, 1999 now abandoned.

TECHNICAL FIELD OF THE INVENTION

The present invention provides a genus of novel compounds having anti-friction properties, wherein the compounds are made by a two-step process wherein the first step is co-reacting a unsaturated synthetic dieneophilic base oil and a compound having a diene structure and a carboxylic acid group, wherein the second step is esterifying the free carboxylic acid group or groups with a poly-hydroxy-containing compound to form the final friction modifier compound.

BACKGROUND OF THE INVENTION

Phosphorus is a poison to noble metal catalysts in the chemical industry. By the same token, studies undertaken by the American Automobile Manufacturers Association (AAMA) have also shown that phosphorus will poison the emission control catalysts in today's automobiles. For that reason, the AAMA and more recently the International Lubricant Standardization and Approval Committed (ILSAC), have placed limits on the amount of phosphorus to be allowed in engine oils, with the long term goal of lowering the phosphorus content enough to render it harmless to automobile catalytic converters. The latest standard, GF-3, limits the phosphorus to no more than 0.1% by weight in motor oils.

One problem with eliminating phosphorus from motor oil formulations is that it provides the polar attractive forces that attach the lubricant molecules to the metal surface, forming an energy-absorbing barrier against friction and wear. Phosphorus-containing additives work in a unique energy band, providing low friction and high wear protection to metals at light to medium loads, such as those found in piston rings and cam followers in an engine. Phosphorus also has the attributes of not forming ash, low toxicity, and being non-metalic. The limit on phosphorus has caused a controversy between the AAMA/ILSAC designers and the formulators of motor oils (*Lubes and Greases* November, 1998).

Traditional lubricity additives contain lead, sulfur, phosphorous, zinc, nitrogen or boron. Lead is now banned. The other additives have been shown to be ash forming or catalyst-poisoning. These additives are thermally activated and form sacrificial chemical bonds to metal surfaces. The bonded additive will then "shear" from the metal surface before the metal itself, resulting in protection of the metal surface from wear. Many additives also contribute to particulate formation, or sludging, during oxidation. Moreover, motor oil lubricity additives can form SOx, NOx and POx emissions, or emissions which can poison the catalysts used in catalytic converters, causing an increase in particulate and hydrocarbon emissions.

Therefore there is a need in the art for lubricity additives that impart needed lubricity properties but provide minimal ash or preferably ash-less properties for the purposes of reducing ultimate pollution and emission characteristics. The invention describes the achievement of that goal.

SUMMARY OF THE INVENTION

The present invention applies renewable resource technology to this field of art to provide an improved ashless additive to petroleum and vegetable lubricant base oils that provides lubricity properties and improved wear protection characteristics. The goal that was achieved by this invention was to provide a fully oil-soluble additive molecule, which is derived from renewable sources and contains no ash or deposit-producing elements or catalyst poisons such as sulfur, phosphorous or boron.

The present invention provides an anti-wear agent (i.e., friction reducing compound), comprising an intermediate adduct of a first moiety reacted in a first reaction with a second moiety to form the intermediate adduct and further esterifying the intermediate adduct with a third moiety in a molar ratio of from about 1:2 to about 2:1, wherein the first moiety is an unsaturated synthetic base oil or an unsaturated synthetic dieneophilic base oil, wherein the second moiety is a compound having a diene conjugated carbon-carbon double bond and a carboxylic acid moiety or anhydride group, wherein the first reaction comprises mixing the first moiety with the second moiety in a molar ratio of from about 1:2 to about 2:1 under an inert atmosphere; and wherein the third moiety is a polyhydroxy compound. Preferably, the first reaction is carried out at a temperature of from about 220° C. to about 320° C., and the second reaction is carried out at a temperature of 150° C. to about 230° C. when the third moiety is a polyhydroxy compound. Preferably, the unsaturated synthetic base oil or an unsaturated synthetic dieneophilic base oil is selected from the group consisting of unsaturated $C_{12}$-$C_{50}$ alkenes, $C_{12}$-$C_{50}$ dienes, naphthenic petroleum base stocks; unsaturated liquid oligomers and polymers, unsaturated polyalphaolefins, unsaturated polyacrylates, unsaturated dehydrated polyol esters; unsaturated $C_{10}$-$C_{24}$, branched or straight chain fatty acids; unsaturated fatty esters having a branched or straight chain mono- or polyunsaturated $C_{10}$-$C_{24}$ fatty acid esterified to a $C_1$-$C_{24}$ straight or branched, saturated or unsaturated alcohol; unsaturated fatty glycol esters having a mono- or polyunsaturated $C_{10}$-$C_{24}$ branched or straight chain fatty acid esterified to one or more hydroxyl sites of a polyol (selected from ethyleneglycol, polyethyleneglycol, proplyeneglycol polypropyleneglycol, polyethoxylated alcohols, trimethylolpropane, pentaerythritol, dimethylolpropane, dipentaerythritol, and trimethylolethane) cyclopentene, cyclopentadiene, cyclohexene, cyclohexadiene, 3-pyrroline; substituted benzene, substituted toluene, substituted xylene, substituted quinone, substituted naphthalene, substituted anthracene, substituted pyrrole, substituted furan, substituted thiophene, substituted pyridine, substituted pyrimidine, substituted imidazole, substituted thiazole; $X_1$-dieneophilic benzoic acid, $X_1$-ester-linked benzyl, $X_1$-ester-linked naphthenic, $X_1$-ester-linked phenol; a branched or straight chain mono- or polyunsaturated $C_{10}$-$C_{24}$ fatty acid; and combinations thereof, wherein the substitution is a mono- or polyunsaturated $C_2$-$C_{25}$ branched or straight chain alkenyl, wherein $X_1$-ester-linked is $C_2$-$C_{24}$ straight or branched carboxylic acid side chains or a $C_1$-$C_{24}$ straight or branched, saturated or unsaturated alcohols. Preferably, the second moiety comprises unsaturated compounds having a diene conjugated carbon-carbon double bond and a carboxylic acid moiety or anhydride group. Most preferably, the second moiety is selected from the group consisting of maleic acid, maleic anhydride, sorbic acid, sorbic anhydride, tetrahydrophthalic anhydride, tetrahydrophthalic acid, salicylic acid, salicylic anhydride, acrylic acid, acrylic anhydride, $C_{1-10}$ alkyl, $C_{2-10}$ alkenyl, or $C_{1-10}$ alkoxy derivatives of the foregoing acids and anhydrides, and combinations thereof. Preferably, the polyhydroxy compound of the third moiety is selected from the group consisting of glycerol, sorbitol, hydroxyquinone, glucose, mannose, 6-carbon sugars, pentose, fructose, 5-carbon sugars, pentaerythritol, catechol, resorcinol, hydroquinone, pyrogallol, 4,4'-dihydroxybiphenyl, 2,4-dihydroxybiphenyl, 2,2'-dihydroxybiphenyl, orthohydroxybenzene, polyhydroxyaromatic compounds having one or two phenyl rings and one or two 5-6 membered aromatic rings having substituted alkyl or alkenyl side chains ($C_{2-10}$) substituted with at least two hydroxyl groups, trimethylolpropane, pentaerythritol, dimethylolpropane, dipentaerythritol, trimethylolethane, ethyleneglycol, polypropyleneglycol, polyethylated alcohols, and combinations thereof. Preferably, the first reaction is conducted at a temperature of 220° C. to about 320° C. under an inert atmosphere to form an intermediate adduct in a Diels-Alder reaction. Preferably, the esterification reaction comprises reaction conditions of from about 150° C. to about 230° C. under an inert atmosphere and further comprises adding an esterification catalyst. Most preferably, the esterification catalyst is an acid catalyst. Most preferably, the esterification catalyst is selected from the group consisting of p-toluene sulfonic acid, hypophosphorous acid, sulfuric acid, hydrochloric acid, phosphoric acid, acid-activated clays, solid acid catalysts, acidic zeolites, and combinations thereof. Most preferably, the lubricity additive compound is made from the first moiety, second moiety and third moiety compounds selected from the group consisting of in order trimethyol propane trioleate-maleic anhydride-sorbitol, trimethyol propane trioleate-sorbic acid-sorbitol.

The present invention further provides a process for synthesizing a friction reducing compound, comprising (a) reacting an unsaturated synthetic base oil or an unsaturated synthetic dieneophilic base oil first moiety with a second moiety in a molar ratio of from about 1:2 to about 2:1 at a temperature of from about 220° C. to about 320° C. under an inert atmosphere to form an intermediate adduct in a Diels-Alder reaction, wherein the second moiety is a compound having a diene conjugated carbon-carbon double bond and a carboxylic acid moiety or anhydride group; and (b) esterifying the intermediate adduct with a third moiety in a molar ratio of from about 1:2 to about 2:1, wherein the third moiety is a polyhydroxy compound.

Preferably, the unsaturated synthetic base oil or an unsaturated synthetic dieneophilic base oil is selected from the group consisting of unsaturated $C_{12}$-$C_{50}$ alkenes, $C_{12}$-$C_{50}$ dienes, naphthenic petroleum base stocks; unsaturated liquid oligomers and polymers, unsaturated polyalphaolefins, unsaturated polyacrylates, unsaturated dehydrated polyol esters; unsaturated $C_{10}$-$C_{24}$, branched or straight chain fatty acids; unsaturated fatty esters having a branched or straight chain mono- or polyunsaturated $C_{10}$-$C_{24}$ fatty acid esterified to a $C_1$-$C_{24}$ straight or branched, saturated or unsaturated alcohol; unsaturated fatty glycol esters having a mono- or polyunsaturated $C_{10}$-$C_{24}$ branched or straight chain fatty acid esterified to one or more hydroxyl sites of a polyol (selected from ethyleneglycol, polyethyleneglycol, proplyeneglycol polypropyleneglycol, polyethoxylated alcohols, trimethylolpropane, pentaerythritol, dimethylolpropane, dipentaerythritol, and trimethylolethane) cyclopentene, cyclopentadiene, cyclohexene, cyclohexadiene, 3-pyrroline; substituted benzene, substituted toluene, substituted xylene, substituted quinone, substituted naphthalene, substituted anthracene, substituted pyrrole, substituted furan, substituted thiophene, substituted pyridine, substituted pyrimidine, substituted imidazole, substituted thiazole; $X_1$-ester-linked benzoic acid, $X_1$-ester-linked benzyl, $X_1$-ester-linked naphthenic, $X_1$-ester-linked phenol; a branched or straight chain mono- or polyunsaturated $C_{10}$-$C_{24}$ fatty acid; and combinations thereof, wherein the substitution is a mono- or polyunsaturated $C_2$-$C_{25}$ branched or straight chain alkenyl, wherein $X_1$-ester-linked is $C_2$-$C_{24}$ straight or branched carboxylic acid side chains or a $C_1$-$C_{24}$ straight or branched, saturated or unsaturated alcohols, and combinations thereof. Preferably, the second moiety comprises unsaturated compounds having a diene conjugated carbon-carbon double bond and a carboxylic acid moiety or anhydride group. Most preferably, the second moiety is selected from the group consisting of maleic acid, maleic anhydride, sorbic acid, sorbic anhydride, tetrahydrophthalic anhydride, tetrahydrophthalic acid, salicylic acid, salicylic anhydride, acrylic acid, acrylic anhydride, $C_{1-10}$ alkyl, $C_{2-10}$ alkenyl, or $C_{1-10}$ alkoxy derivatives of the foregoing acids and anhydrides, and combinations thereof. Preferably, the polyhydroxy compound of the third moiety is selected from the group consisting of glycerol, sorbitol, hydroxyquinone, glucose, mannose, 6-carbon sugars, pentose, fructose, 5-carbon sugars, pentaerythritol, catechol, resorcinol, hydroquinone, pyrogallol, 4,4'-dihydroxybiphenyl, 2,4-dihydroxybiphenyl, 2,2'-dihydroxybiphenyl, orthohydroxybenzene, polyhydroxyaromatic compounds having one or two phenyl rings and one or two 5-6 membered aromatic rings having substituted alkyl or alkenyl side chains ($C_{2-10}$) substituted with at least two hydroxyl groups, trimethylolpropane, pentaerythritol, dimethylolpropane, dipentaerythritol, trimethylolethane, ethyleneglycol, polypropyleneglycol, polyethylated alcohols, and combinations thereof. Preferably, the first reaction is conducted under an inert atmosphere. Preferably, the esterification reaction comprises reaction conditions of from about 150° C. to about 230° C. under an inert atmosphere and further comprises adding an esterification catalyst. Most preferably, the esterification catalyst is an acid catalyst. Most preferably, the esterification catalyst is selected from the group consisting of p-toluene sulfonic acid, hypophosphorous acid, sulfuric acid, hydrochloric acid, phosphoric acid, acid-activated clays, solid acid catalysts, acidic zeolites, and combinations thereof.

The present invention further provides an anti-wear supplement composition for addition to lubricant formulas (such as crankcase oils, gear lubricants, hydraulic fluids, total loss lubricants, metal working fluids and the like), comprising from about 1.0% to about 50% by weight of a non-phosphorous anti-wear compound, from about 0% to about 25% by weight of a phosphorous additive, from about 0% to about 10% of an extreme pressure additive, from about 0% to about 25% of a solubility stabilizer, and from about 25% to about 75% of a base oil carrier, wherein the non-phosphorous anti-wear compound comprises an intermediate adduct of a first moiety reacted in a first reaction with a second moiety to form the intermediate adduct and further esterifying the intermediate adduct with a third moiety in a molar ratio of from about 1:2 to about 2:1, wherein the first moiety is an unsaturated synthetic base oil or an unsaturated synthetic dieneophilic base oil, wherein the second moiety is a compound having a diene conjugated carbon-carbon double bond and a carboxylic acid moiety or anhydride group, wherein the first reaction comprises mixing the first moiety with the second moiety in a molar ratio of from about 1:2 to about 2:1 at a temperature of from about 220° C. to about 320° C. under an inert atmosphere; and wherein the third moiety is a polyhydroxy compound. Preferably, the unsaturated synthetic base oil or an unsaturated synthetic dieneophilic base oil is selected from the group consisting of unsaturated $C_{12}$-$C_{50}$ alkenes, $C_{12}$-$C_{50}$ dienes, naphthenic petroleum base stocks; unsaturated liquid oligomers and polymers, unsaturated polyalphaolefins, unsaturated polyacrylates, unsaturated dehydrated polyol esters; unsaturated $C_{10}$-$C_{24}$, branched or straight chain fatty acids; unsaturated fatty esters having a branched or straight chain mono- or polyunsaturated $C_{10}$-$C_{24}$ fatty acid esterified to a $C_1$-$C_{24}$ straight or branched, saturated or unsaturated alcohol; unsaturated fatty glycol esters having a mono- or polyunsaturated $C_{10}$-$C_{24}$ branched or straight chain fatty acid esterified to one or more hydroxyl sites of a polyol (selected from ethyleneglycol, polyethyleneglycol, proplyeneglycol polypropyleneglycol, polyethoxylated alcohols, trimethylolpropane, pentaerythritol, dimethylolpropane, dipentaerythritol, and trimethylolethane) cyclopentene, cyclopentadiene, cyclohexene, cyclohexadiene, 3-pyrroline; substituted benzene, substituted toluene, substituted xylene, substituted quinone, substituted naphthalene, substituted anthracene, substituted pyrrole, substituted furan, substituted thiophene, substituted pyridine, substituted pyrimidine, substituted imidazole, substituted thiazole; $X_1$-ester-linked benzoic acid, $X_1$-ester-linked benzyl, $X_1$-ester-linked naphthenic, $X_1$-ester-linked phenol; a branched or straight chain mono- or polyunsaturated $C_{10}$-$C_{24}$ fatty acid; and combinations thereof, wherein the substitution is a mono- or polyunsaturated $C_2$-$C_{25}$ branched or straight chain alkenyl, wherein $X_1$-ester-linked is $C_2$-$C_{24}$ straight or branched carboxylic acid side chains or a $C_1$-$C_{24}$ straight or branched, saturated or unsaturated alcohols. Preferably, the second moiety comprises unsaturated compounds having a diene conjugated carbon-carbon double bond and a carboxylic acid moiety or anhydride group. Most preferably, the second moiety is selected from the group consisting of maleic acid, maleic anhydride, sorbic acid, sorbic anhydride, tetrahydrophthalic anhydride, tetrahydrophthalic acid, salicylic acid, salicylic anhydride, acrylic acid, acrylic anhydride, $C_{1-10}$ alkyl, $C_{2-10}$ alkenyl, or $C_{1-10}$ alkoxy derivatives of the foregoing acids and anhydrides, and combinations thereof. Preferably, the polyhydroxy compound of the third moiety is selected from the group consisting of glycerol, sorbitol, hydroxyquinone, glucose, mannose, 6-carbon sugars, pentose, fructose, 5-carbon sugars, pentaerythritol, orthohydroxybenzene, polyhydroxyaromatic compounds having one or two phenyl rings and at least two hydroxyl groups (e.g., having a phenyl moiety substituted in any of the foregoing polyhydroxy compounds), trimethylolpropane, polyethoxylated alcohols, and combinations thereof. Preferably, the first reaction is conducted under continuous mixing. Preferably, the esterification reaction comprises reaction conditions of from about 150° C. to about 230° C. under an inert atmosphere and further comprises adding an esterification catalyst. Most preferably, the esterification catalyst is an acid catalyst. Most preferably, the esterification catalyst is selected from the group consisting of p-toluene sulfonic acid, hypophosphorous acid, sulfuric acid, hydrochloric acid, phosphoric acid, acid-activated clays, solid acid catalysts, acidic zeolites, and combinations thereof.

DETAILED DESCRIPTION OF THE INVENTION

Product-By-Process

The present invention provides an anti-wear (i.e., friction modifying) compound that is the product of a two step reaction involving three starting materials, each selected from a first class of agents (including combinations within the class), a second class of agents (including combinations within the class), and a third class of agents. The first reaction reagent is an unsaturated synthetic base oil or an unsaturated synthetic dieneophilic base oil that is reacted in a Diels Alder reaction with a second class of agents. The unsaturated synthetic base oil or an unsaturated synthetic dieneophilic base oil class can be broadly described as being selected from the group consisting of unsaturated $C_{12}$-$C_{50}$ alkenes, $C_{12}$-$C_{50}$ dienes, naphthenic petroleum base stocks; unsaturated liquid oligomers and polymers such as unsaturated polyalphaolefins, polyacrylates or dehydrated polyol esters; unsaturated $C_{10}$-$C_{24}$, branched or straight chain fatty acids; unsaturated fatty esters consisting of a branched or straight chain mono- or polyunsaturated $C_{10}$-$C_{24}$ fatty acid esterified to a $C_1$-$C_{24}$ straight or branched, saturated or unsaturated alcohol; unsaturated fatty glycol esters having a mono- or polyunsaturated $C_{10}$-$C_{24}$ branched or straight chain fatty acid esterified to one or more hydroxyl sites of a polyol such as ethyleneglycol, polyethyleneglycol, proplyeneglycol polypropyleneglycol, polyethoxylated alcohols, trimethylolpropane, pentaerythritol, dimethylolpropane, dipentaerythritol, trimethylolethane; unsaturated cyclic aliphatic rings including cyclopentene, cyclopentadiene, cyclohexene, cyclohexadiene, and 3-pyrroline; cyclic aliphatics with unsaturated branched or straight side chains; aromatic compounds benzene, toluene, xylene, quinone, naphthalene, anthracene, pyrrole, furan, thiophene, pyridine, pyrimidine, imidazole, and thiazole; listed aromatic compounds with mono- and polyunsaturated $C_2$-$C_{25}$ branched and straight alkyl side chains; esters of aromatic acids such as benzoic, benzyl, naphthenic, and the listed aromatic compounds with $C_2$-$C_{24}$ straight or branched carboxylic acid side chains, and phenol or $C_1$-$C_{24}$ straight or branched, saturated or unsaturated alcohols; aromatic esters of phenol and a branched or straight chain mono- or polyunsaturated $C_{10}$-$C_{24}$ fatty acid; and combinations thereof. Preferably, the second moiety comprises unsaturated compounds having a diene conjugated carbon-carbon double bond and a carboxylic acid moiety or anhydride group. Most preferably, the second moiety is selected from the group consisting of maleic acid, maleic anhydride, sorbic acid, sorbic anhydride, tetrahydrophthalic anhydride, tetrahydrophthalic acid, salicylic acid, salicylic anhydride, acrylic acid, acrylic anhydride, $C_{1-10}$ alkyl, $C_{2-10}$ alkenyl, or $C_{1-10}$ alkoxy derivatives of the foregoing acids and anhydrides, and combinations thereof.

The unsaturated synthetic base oil or an unsaturated synthetic dienophilic base oil is reacted with a second moiety. The first and second moieties form an intermediate product.

The intermediate product is isolated and reacted with a third moiety. Preferably, the polyhydroxy compound of the third moiety is selected from the group consisting of glycerol, sorbitol, hydroxyquinone, glucose, mannose, 6-carbon sugars, pentose, fructose, 5-carbon sugars, pentaerythritol, catechol, resorcinol, hydroquinone, pyrogallol, 4,4'-dihydroxybiphenyl, 2,4-dihydroxybiphenyl 2,2'-dihydroxybiphenyl, orthohydroxybenzene, polyhydroxyaromatic compounds having one or two phenyl rings and one or two 5-6 membered aromatic rings having substituted alkyl or alkenyl side chains ($C_{2-10}$) substituted with at least two hydroxyl groups, trimethylolpropane, pentaerythritol, dimethylolpropane, dipentaerythritol, trimethylolethane, ethyleneglycol, polypropyleneglycol, polyethylated alcohols, and combinations thereof.

Synthetic Process

The synthetic process for the production of the inventive non-phosphorous anti-wear (i.e., friction-modifying) compound is a two-step process. The first step reacts the unsaturated synthetic base oil or an unsaturated synthetic dieneophilic base oil with a dieneophile in a Diels-Alder reaction. This first step is an adduction reaction accomplished by reacting an unsaturated site of the unsaturated synthetic base oil or an unsaturated synthetic dieneophilic base oil, such as trimethylol propane trioleate (TMP-TO), with a dieneophile having conjugation of the double bonds and carboxylic acid group. Examples of the dieneoids are maleic anhydride, acrylic acid, sorbic acid, and ascorbic acid (vitamin C). All of the adducts are characterized by having a conjugated double bond moiety that is not sterically hindered for the Diels-Alder reaction and a free carboxylic acid moiety available for reaction in the second process step.

The Diels-Alder reaction is initiated, for example, by mixing the unsaturated synthetic dieneophilic base oil and the dieneophile on a 1:1 molar basis and heating (range of 220° C. to 320° C.).The Diels Alder reaction proceeded until there was a clear, single phase solution without unreacted adduct component and with sufficient acid value to indicate completion. The results of the first reaction step using TMP-TO as the unsaturated synthetic dieneophilic base oil and either styrene, maleic anhydride, acrylic acid or sorbic acid at various molar ratios is provided in Table 1.

TABLE 1

Process Results of the Diels-Alder Reaction of TMP-TO and Dieneoids

| Dieneoid | Mole Ratio Cien:TMP | Exotherm, Max Delta, C | Acid Number | Iodine Number | % Complete (calculated) |
|---|---|---|---|---|---|
| Styrene | 1:1 | Liquid Addition | 0.4 | 79.7 | 88 |
| | 2:1 | Liquid Addition | 0.3 | 70.2 | 63 |
| | 3:1 | Liquid Addition | 0.2 | 68.2 | 47 |
| Maleic Anhydride | 0.5:1 | 9 | 24.6 | 74.7 | 100 |
| | 1:1 | 24 | 65.9 | 58.7 | 85 |
| | 1.25:1 | 90 | 77.7 | 48.2 | 85 |
| Acrylic Acid | 0.5:1 | Liquid Addition | 26.2 | 81.0 | 100 |
| | 1:1 | Liquid Additon | 100 | 66.3 | 100 |
| | 2:1 | Liquid Addition | Acrylic polymerization reaction controls | | |
| Sorbic Acid | 1:1 | <5 | 55.0 min | 80.0 | 95 |

The second step reacts the carboxylic acid moiety on an aliphatic ring intermediate with a polyol polar reactant in an esterification reaction to form final products that are lubricity additives. Illustrative polyols include glycerol (three hydroxyl groups) and the sugar derivative sorbitol with six chiral hydroxyl groups. The second reaction step was carried out in the presence of hypophosphorous acid (and could also include, for example, solid acids such as silica gel, alumina or acid-activated clays, or combinations thereof) and an optional esterification catalyst (preferably at the lower reaction temperatures) at a temperature within the range of from about 150° C. to about 230° C.

The Diels-Alder reaction products that retained acid functionality were the base stocks for ester reaction used to add functional, polar compounds to the acid site that resulted in anti-wear and anti-friction properties in a Four Ball test. The second process step comprises a reaction of the active carboxylic acid site on the intermediate product with polyols to form the anti-friction products. Two of the polyols were chosen to illustrate the breadth of the chemistry involved. The first example represented a few active sites and the second example represents many active sites. Glycerine (three hydroxyls) was chosen as having few active sites on a polyol and sorbitol (six hydroxyls) was used as the reagent having many active sites.

The esterification reaction of the polyol is carried out in the presence of hydrophosphorous acid, an esterification catalyst, at temperatures in the range of 150-230° C. Sorbitol was added as a solid and heated to about 120° C. under a nitrogen atmosphere. The catalyst was then added and heating continued to achieve a reaction temperature. A vacuum of at least 26 mm Hg was applied to facilitate water removal. The end of the esterification reaction was reached when the TAN fell to a level of less than 8 mg KOH per gram of sample. The resulting sorbitol ester products were not clear and a small amount of polymerized sorbitol (about 0.2% by weight) was filtered out of the solution. The viscosity of the resulting product was 450 cps at 40° C.

Commercial Applications and Formulations

Without being bound by theory, the anti-wear and lubricity affects of the inventive compound were not competitive with phosphorous and sulfur-based lubricity additives that are commonly used in the art. Sulfur (anti-wear agent) and phosphorous (anti-friction agent), by contrast, often used together in a balanced additive formulation, are competitive with each other in their respective operational ranges. This means that a reduced phosphorous load in a lubricant which also requires extreme pressure lubrication could either perform better in the extreme pressure range with unchallenged sulfur composition or an equal performance could be had with reduced levels of both phosphorous and sulfur. These data indicate that the inventive lubricity additives are synergistic with traditional phosphorous and sulfur-based additives and can significantly diminish the needed concentrations of sulfur and phosphorous compositions used. Moreover, not only can the phosphorous concentrations be reduced by 50% or more, the resulting lubricant additive composition will have better anti-wear performance and better thermal stability. Therefore, a lubricant additive composition comprising the inventive compound in combination with a traditional phosphorous-based or sulfur-based anti-wear and friction modifying compound will have a synergistic effect. Moreover, a reduction in the phosphorous content of a lubricant additive package will make the resulting formulation less harmful to exhaust catalysts and more environmentally benign.

The present invention further provides an anti-wear supplement composition for addition to lubricant formulas (such as crankcase oils, gear lubricants, hydraulic fluids, total loss lubricants, metal working fluids and the like), comprising from about 1.0% to about 50% by weight of a non-phosphorous friction modifier compound, from about 0% to about 25% by weight of a phosphorous additive, from about 0% to about 10% of an extreme pressure additive, from about 0% to about 25% of a solubility stabilizer, and from about 25% to about 75% of a base oil carrier, wherein the non-phosphorous anti-wear compound comprises an intermediate adduct of a first moiety reacted in a first reaction with a second moiety to form the intermediate adduct and further esterifying the intermediate adduct with a third moiety in a molar ratio of from about 1:2 to about 2:1, wherein the first moiety is an unsaturated synthetic base oil or an unsaturated synthetic dieneophilic base oil, wherein the second moiety is a compound having a diene conjugated carbon-carbon double bond and a carboxylic acid moiety or anhydride group, wherein the first reaction comprises mixing the first moiety with the second moiety in a molar ratio of from about 1:2 to about 2:1 at a temperature of from about 220° C. to about 320° C. under an inert atmosphere; and wherein the third moiety is a polyhydroxy compound. Preferably, unsaturated synthetic base oil or an unsaturated synthetic dieneophilic base oil is selected from the group consisting of unsaturated $C_{12}$-$C_{50}$ alkenes, $C_{12}$-$C_{50}$ dienes, naphthenic petroleum base stocks; unsaturated liquid oligomers and polymers, unsaturated polyalphaolefins, unsaturated polyacrylates, unsaturated dehydrated polyol esters; unsaturated $C_{10}$-$C_{24}$, branched or straight chain fatty acids; unsaturated fatty esters having a branched or straight chain mono- or polyunsaturated $C_{10}$-$C_{24}$ fatty acid esterified to a $C_1$-$C_{24}$ straight or branched, saturated or unsaturated alcohol; unsaturated fatty glycol esters having a mono- or polyunsaturated $C_{10}$-$C_{24}$ branched or straight chain fatty acid esterified to one or more hydroxyl sites of a polyol (selected from ethyleneglycol, polyethyleneglycol, proplyeneglycol polypropyleneglycol, polyethoxylated alcohols, trimethylolpropane, pentaerythritol, dimethylolpropane, dipentaerythritol, and trimethylolethane) cyclopentene, cyclopentadiene, cyclohexene, cyclohexadiene, 3-pyrroline; substituted benzene, substituted toluene, substituted xylene, substituted quinone, substituted naphthalene, substituted anthracene, substituted pyrrole, substituted furan, substituted thiophene, substituted pyridine, substituted pyrimidine, substituted imidazole, substituted thiazole; $X_1$-ester-linked benzoic acid, $X_1$-ester-linked benzyl, $X_1$-ester-linked naphthenic, $X_1$-ester-linked phenol; a branched or straight chain mono- or polyunsaturated $C_{10}$-$C_{24}$ fatty acid; and combinations thereof, wherein the substitution is a mono- or polyunsaturated $C_2$-$C_{25}$ branched or straight chain alkenyl, wherein $X_1$-ester-linked is $C_2$-$C_{24}$ straight or branched carboxylic acid side chains or a $C_1$-$C_{24}$ straight or branched, saturated or unsaturated alcohols. Preferably, the second moiety comprises unsaturated compounds having a diene conjugated carbon-carbon double bond and a carboxylic acid moiety or anhydride group. Most preferably, the second moiety is selected from the group consisting of maleic acid, maleic anhydride, sorbic acid, sorbic anhydride, tetrahydrophthalic anhydride, tetrahydrophthalic acid, salicylic acid, salicylic anhydride, acrylic acid, acrylic anhydride, $C_{1-10}$ alkyl, $C_{2-10}$ alkenyl, or $C_{1-10}$ alkoxy derivatives of the foregoing acids and anhydrides, and combinations thereof. Preferably, the polyhydroxy compound of the third moiety is selected from the group consisting of glycerol, sorbitol, hydroxyquinone, glucose, mannose, 6-carbon sugars, pentose, fructose, 5-carbon sugars, pentaerythritol, orthohydroxybenzene, polyhydroxyaromatic compounds having one or two phenyl rings and at least two hydroxyl groups (e.g., having a phenyl moiety substituted in any of the foregoing polyhydroxy compounds), trimethylolpropane, polyethoxylated alcohols, and combinations thereof. Preferably, the first reaction is conducted under continuous mixing. Preferably, the esterification reaction comprises reaction conditions of from about 150° C. to about 230° C. under an inert atmosphere and further comprises adding an esterification catalyst. Most preferably, the esterification catalyst is an acid catalyst. Most preferably, the esterification catalyst is selected from the group consisting of p-toluene sulfonic acid, hypophosphorous acid, sulfuric acid, hydrochloric acid, phosphoric acid, acid-activated clays, solid acid catalysts, acidic zeolites, and combinations thereof.

The other components that may be present in the inventive include from about 0% to about 25% by weight of a phosphorous additive, from about 0% to about 10% of an extreme pressure additive, from about 0% to about 25% of a solubility stabilizer, and from about 25% to about 75% of a base oil carrier. Examples of a phosphorous additive are alkyl amine phosphate, tri-cresyl phosphate, and diethyl hydrogen phosphite. Examples of an extreme pressure additive are sulfurized lard, sulfurized polyisobutene, and chlorinated parafin. Examples of a solubility stabilizer are alkyl esters, liquid wax esters, and phosphate esters. Examples of base oil carriers are petroleum oils, synthetic esters, and polyalphaolefins.

The inventive anti-wear supplement composition for addition to lubricant formulas may be added to a variety of different lubricity final product applications. Table 2 shows examples of different product applications, the concentration range of the anti-wear supplement to be added (by weight) and the final concentration range within the final lubricant formulation of the inventive compound, with TMOSS (Trimethylolpropane Trioleate-sorbitol-sorbate) used as an exemplary compound.

TABLE 2

| Product Application | TMOSS % Supplement Formulation | TMOSS % in Application |
|---|---|---|
| Crankcase oil (gasoline) | 0.1-10% | 0.1-5% |
| Crankcase oil (diesel) | 0.2-20% | 0.1-10% |
| Crankcase oil (alternative fuels) | 0.1-10% | 0.1-5% |
| Gear lubricant (automotive) | 0.1-10% | 0.1-10% |
| Gear lubricant (industrial) | 0.2-20% | 0.1-10% |
| Gear lubricant (exotic, nonferrous) | 0.2-20% | 0.1-10% |
| Hydraulic fluids | 0.1-10% | 0.1-5% |
| Fuel lubricity additive | 100-2000 ppm | 10-500 ppm |
| Bar chain oils | 0.2-20% | 0.1-10% |
| Wire rope lubes | 0.2-20% | 0.1-10% |
| Way Lubes | 0.2-20% | 0.1-10% |
| Greases | 0.2-20% | 0.1-10% |
| Neat cutting oils (metalworking) | 0.2-20% | 0.1-10% |
| Water emulsions (metalworking) | 0.1-10% | 0.1-10% |

In particular, the inventive compounds are useful for anti-wear and anti-friction characteristics in crankcase oils, such as for gasoline engines. A formulation for a gasoline engine crankcase oil will have, for example (all percentages are by weight), from about 0.1% to about 10% of the inventive anti-wear compound (e.g., TMOSS), from about 0% to about 0.2% of a phosphorous additive, from about 0% to about 1% of an extreme pressure additive, from about 3% to about 10% of a viscosity index improver, from about 0.1% to about 1.0% of an anit-oxidant, from about 0.1% to about 1.0% of a pour point depressant, from about 2.0% to about 5.0% of a dispersant, from about 1.0% to about 5.0% of a detergent, and from about 80% to about 95% of a base oil carrier. Examples of a phosphorous additive include alkyl amine phosphate, tri-cresyl phosphate, and diethyl hydrogen phosphite. Examples of an extreme pressure additive include sulfurized lard, sulfurized polyisobutene, and chlorinated paraffin. Examples of a viscosity index improver include ABS polymer, acrylic polymer, and olefin copolymer. Examples of an anti-oxidant include alkyl hydroquinone, phenylamine compounds, and phenolic compounds. Examples of pour point depressants incude ethylene vinylacetate polymer, acrylic polymer, and methacrylic polymer. An example of a dispersant is polyisobutylsuccinamides. Examples of detergents include metal petroleum sulfonates and metal phenates. Examples of base oil carriers include petroleum oils, synthetic esters, and polyalphaolefins.

EXAMPLE 1

This example illustrates the synthesis of Trimethylolpropane Trioleate-sorbitol-sorbate, (TMOSS) which is the product of the reaction of a sorbic acid fed into dried, degassed TMP-TO at 260° C. over a 6 hour period with constant agitation and under a nitrogen blanket until a 1:1 molar mix was achieved. The reaction was continued at temperature and agitation to form an intermediate adduct. The reaction was over when the adduct was clear at room temperature and the TAN was greater then 55 mg KOH per gram sample. A second reaction of the intermediate adduct with sorbitol was performed by adding 0.9 moles of sorbitol per mole of intermediate to the reactor and heating to 120° C. As this temperature was reached, hypophosphorus acid catalyst was added at a level of 0.5% by weight and the temperature increased to 200° C. A full vacuum was pulled through the cold water condenser section set up to separate the water produced by the condensation reaction that forms TMOSS. The reaction was finished when the TAN was <8 mg KOH/g Sample. The product was cloudy with less than 0.5% of insoluble polysorbate solids. These were filtered out to yield a clear, golden liquid product.

EXAMPLE 2

This example provides a comparison of oxidation stability of TMOSS prepared in Example 1 with a fuel lubricity additive compound prepared by the same process as the TMOSS from Example 1 but with a vegetable oil (soy oil) instead of an unsaturated synthetic dieneophilic base oil. Both compounds were dissolved in a low volatility, high stability 5 cSt engine oil base produced by severely hydrotreating and isomerizing a parafinic petroleum lubricant base stock such that its viscosity index is 114-119 and its Noack Volatility is 16 or less at 5% by weight for each. The mixtures were exposed to air and catalytic metallic surfaces at 135° C. for 168 hours to simulate extended engine oxidative stress. Both motor oil formulations were tested for oxidative damage in a comparison of the amount of improvement of the TMOSS formulation over the fuel lubricity additive formulation.

| Test Criterion | Improvement of TMOSS after 168 hrs @ 135° C. |
|---|---|
| Viscosity increase | No difference |
| TAN increase | No difference |
| Sludge generation | 99.8% less sludge with TMOSS |
| Lubricity change | 3% more wear improvement with TMOSS |

These data show that the TMOSS is as effective at preventing wear as the additive made by the same process from soybean oil, but is much more stable in high temperature, oxidizing conditions, as would be found in an engine crankcase. The high stability is shown by the virtual elimination of the sludge that precipitated from the soybean oil-based sample. Thus, TMOSS was much more suitable for use in crankcase oils and other formulations that are used in high temperature, oxidizing conditions.

EXAMPLE 3

This example provides a comparison of wear protection properties of TMOSS prepared in Example 1 with a fuel lubricity additive compound similarly prepared in Example 1 but with a soybean oil instead of an unsaturated synthetic base oil or an unsaturated synthetic dieneophilic base oil. Both compounds were dissolved in a low volatility, high stability 5 cSt engine oil base produced by severely hydrotreating and isomerizing a parafinic petroleum lubricant base stock such that its viscosity index is 114-119 and its Noack Volatility is 16 or less. Both motor oil formulations were tested in a Four Ball Wear Test according to ASTM method D 4172. Both additives at the 5% by weight concentration show an improved wear resistance.

| Product tested | Wear scar diameter (mm) |
|---|---|
| Motor oil base | 0.90 |
| Fuel lubricity additive | 0.41 |
| TMOSS | 0.39 |

Both additives at the 5% (by weight) concentration showed significantly improved wear resistance over the petroleum base oil. The improvements were equal within the limits of the test.

EXAMPLE 4

This example shows the friction reduction qualities and steel scuffing protection of TMOSS prepared in Example 1. TMOSS was dissolved in a fully formulated, commercial 85W140, GL-5 automotive gear oil at 5% by weight. The gear oil, with and without TMOSS, was tested in a Falex Pin and Vee Block apparatus according to ASTM Method D 3233. The TMOSS addition showed an impressive increase in lubricity.

| Product Tested | 250 lb Clamping ForceTorque (lb) | Clamping Force at Failure (lbs) |
|---|---|---|
| Gear oil alone | 12 | 1300 |
| TMOSS Added | 9 | 1550 |

These data show that the addition of a small amount of TMOSS lowered the friction of metal-to metal sliding contact at 250 lbs of load, implying more efficient power uses, and increases the amount of load ultimately required to damage the metal surface, implying longer equipment life. This improvement occurs even in a fully formulated, commercial lubricant, containing additional additives for friction and wear reduction.

EXAMPLE 5

This example shows wear reduction synergy between TMOSS prepared in Example 1 and an anti-wear additive containing 4% (by weight) phosphorous linked to a fatty ester. Three samples, each consisting of the two aforementioned anti-wear components either alone or in a 50:50 mixture of both was dissolved in a low volatility, high stability 5 cSt engine oil base produced by severely hydrotreating and isomerizing a parafinic petroleum lubricant base stock (such that its viscosity index was 114-119 and its Noack Volatility was 16 or less). All three samples were tested in a Four Ball Wear Test according to ASTM method D4172.

| Product Tested | Wear scar diameter (mm) |
|---|---|
| Petroleum base oil | 0.90 |
| Phosphorous anti-wear additive | 0.45 |
| TMOSS | 0.39 |
| 50:50 mix of Phosphorous and TMOSS | 0.31 |

These data show that the inventive compound (e.g., TMOSS) used in conjunction with a typical phosphorous anti-wear agent was synergistic and can drive the phosphorous levels needed in a lubricant composition or a lubricant additive package lower by at least 50% or more with equal or better anti-wear properties and greater thermal stability. Phosphorous and sulfur compounds used for an EP/anti-wear package are often competitive with each other in their respective operational ranges. Therefore, a reduced phosphorous load in a lubricant which also requires EP lubrication could either perform better in the extreme pressure range with unchanged sulfur composition, or provide an equal performance with reduced levels of both phosphorous and sulfur with the addition of the inventive compound (e.g., TMOSS).

EXAMPLE 6

This example provides a comparison of lubricity of TMOSS prepared in Example 1 in an oil-in-water emulsion metal working fluid. TMOSS was dissolved at 5% by weight into the oil phase of a metal working fluid formulation comprised of a sulfur-based extreme pressure agent, alkalinity additives and emulsifiers all dissolved in a medium viscosity index petroleum oil, and then the oil mixture was emulsified with water at a dilution rate of one part oil mix to 40 parts water. Emulsions with and without TMOSS were tested in a Falex Pin and Vee Block apparatus according to ASTM method D 3233. The TMOSS addition showed an impressive increase in lubricity.

| Product Tested | Force at Failure (lbs) |
|---|---|
| Emulsion alone | 1200 |
| Emulsion with TMOSS Added | 1750 |

These data show that the TMOSS is surface active and lubricating on the metal surface even in a highly polar water-based medium. The result that the emulsion was stable with the TMOSS is also significant in that the TMOSS is shown to be an effective additive for phosphorus-free metalworking fluids. Furthermore, most water-based metalworking fluid formulations are alkaline to retard bacterial growth and to stabilize the emulsion. Thus, acidic phosphorous compounds are not generally used. Essentially neutral pH inventive compounds (e.g., TMOSS) are no more susceptible to basic environments than any ester material.

EXAMPLE 7

This example provides a comparison of lubricity of a TMOSS lubricity additive treated under severe conditions and measured on non-ferrous metal surfaces. The test lubricants were a control sample of low volatility high stability 5 cSt engine base oil produced by severely hydro treating and isomerizing a paraffinic petroleum lubricant base stock such that its viscosity index was 114-119 and its NOACK Volatility was 16 or less. Prior to this severe treatment, the engine base oil had 0.5% (by weight) TMOSS added. Four one half inch diameter brass (an alloy of copper and zinc) spheres were held in a stationary position in a fixture and used for a Four Ball EP procedure ASTM D1. The fixture was filled with either control severely treated lubricant or the same control but having 0.5% TMOSS added before severe treatment. The load was 36 kg. The apparatus was run for 20 sec and the wear scars were measured.

| Sample Tested | Wear scar diameter (mm) |
|---|---|
| Control | 2.85 |
| 0.5% TMOSS added | 0.58 |

These data show that TMOSS protected the surface of the brass spheres from the abrasive wear of the test. Wear protection for alloys of copper is especially important for brass bushings on shafts and bronze worm gears. Conventional phosphorous and sulfur lubricity agents are not used in these applications because of the reactivity of the copper. TMOSS and the other inventive compounds allow these metals to be protected from wear without the penalty of corrosion and pitting.

EXAMPLE 8

This example a comparison of lubricity of a TMOSS lubricity additive at different concentrations of addition treated under severe conditions and measured on ferrous on brass metal surfaces. This test was designed to mimic a wear situation typically seen where steel shafts rotate in a brass bushing. The test lubricants were a control sample of low volatility high stability 5 cSt engine base oil produced by severely hydro treating and isomerizing a paraffinic petroleum lubricant base stock such that its viscosity index was 114-119 and its NOACK Volatility was 16 or less. Prior to this severe treatment, the engine base oil had different amounts (by weight) TMOSS added. Three one half inch diameter brass (an alloy of copper and zinc) spheres and one similarly-sized steel sphere were held in a stationary position in a fixture and used for a Four Ball EP procedure ASTM D1. The fixture was filled with either control severely treated lubricant or the same control but having 0.5% TMOSS added before severe treatment. The load was 360 kg. The apparatus was run for 30 sec and the wear scars were measured.

| Sample Tested | Wear scar diameter (mm) |
|---|---|
| Control | 4.19 |
| 5.0% TMOSS added | 1.23 |
| 1.0% TMOSS added | 1.23 |
| 0.25% TMOSS added | 1.25 |

These data show not only the effectiveness of the inventive compound as an anti-wear agent but also that even the smallest concentrations were effective.

We claim:

1. An anti-wear compound comprising:

reacting a first moiety with a second moiety in a molar ratio of from about 1:2 to about 2:1 at a temperature of from about 220° C. to about 320° C. under an inert atmosphere to form an intermediate adduct; and esterfying the intermediate adduct with a third moiety in a molar ratio of from about 1:2 to about 2:1 wherein the first moiety is an unsaturated synthetic base oil or an unsaturated synthetic dieneophilic base oil, the second moiety is a compound having a conjugated diene and a carboxylic acid or anhydride group, and the third moiety is a polyhydroxy compound.

2. The anti-wear compound of claim 1 wherein the unsaturated synthetic base oil or the unsaturated synthetic dieneophilic base oil is selected from the group consisting of unsaturated $C_{12}$-$C_{50}$ alkenes, $C_{12}$-$C_{50}$ dienes, unsaturated polyalphaolefins, unsaturated polyacrylates, unsaturated dehydrated polyol esters; unsaturated fatty esters having a branched or straight chain mono- or polyunsaturated $C_{10}$-$C_{24}$ fatty acid esterified to a $C_1$-$C_{24}$ straight or branched, saturated or unsaturated alcohol; unsaturated fatty polyol esters having a mono- or polyunsaturated $C_{10}$-$C_{24}$ branched or straight chain fatty acid esterified to one or more hydroxyl sites of a polyol selected from ethyleneglycol, polyethyleneglycol, propyleneglycol, polypropyleneglycol, polyethoxylated alcohols, trimethylolpropane, pentaerythritol, dimethylolpropane, dipentaerythritol, and trimethylolethane; cyclopentene, cyclopentadiene, cyclohexene, cyclohexadiene, 3-pyrroline; substituted benzene, substituted toluene, substituted xylene, substituted quinone, substituted naphthalene, substituted anthracene, substituted pyrrole, substituted furan, substituted thiophene, substituted pyridine, substituted pyrimidine, substituted imidazole, substituted thiazole; $X_1$-ester-linked benzoic acid, $X_1$-ester-linked benzyl, $X_1$-ester-linked naphthenic, $X_1$-ester-linked phenol; a branched or straight chain mono- or polyunsaturated $C_{10}$-$C_{24}$ fatty acid; and combinations thereof, wherein the substitution is a mono- or polyunsaturated $C_2$-$C_{25}$ branched or straight chain alkenyl, wherein $X_1$-ester-linked is $C_2$-$C_{24}$ straight or branched carboxylic acid side chains or a $C_1$-$C_{24}$ straight or branched, saturated or unsaturated alcohols.

3. The anti-wear compound of claim 1 wherein the second moiety is selected from a group consisting of sorbic acid, sorbic anhydride, salicylic acid, salicylic anhydride, $C_{1-10}$ alkyl, $C_{2-10}$ alkenyl, or $C_{1-10}$ alkoxy derivatives of the foregoing acids and anhydrides, and combinations thereof.

4. The anti-wear compound of claim 1 wherein the polyhydroxy compound of the third moiety is selected from the group consisting of glycerol, sorbitol, hydroxyquinone, glucose, mannose, 6-carbon sugars, pentose, fructose, 5-carbon sugars, pentaerythritol, catechol, resorcinol, hydroquinone, pyrogallol, 4,4'-dihydroxybiphenyl, 2,4-dihydroxybiphenyl, 2,2'-dihydroxybiphenyl, orthohydroxybenzene, polyhydroxyaromatic compounds having one or two phenyl rings and one or two 5-6 membered aromatic rings having substituted alkyl or alkenyl side chains ($C_{2-10}$) substituted with at least two hydroxyl groups, trimethylolpropane, dimethylolpropane, dipentaerythritol, trimethylolethane, ethyleneglycol, polypropyleneglycol, polyethoxylated alcohols, and combinations thereof.

5. The anti-wear compound of claim 1 wherein the first reaction is conducted under continuous mixing.

6. The anti-wear compound of claim 1 wherein the esterification reaction comprises reaction conditions of from about 150° C. to about 230° C. under an inert atmosphere and further comprises adding an esterification catalyst.

7. The anti-wear compound of claim 6 wherein the esterification catalyst is an acid catalyst.

8. The anti-wear compound of claim 7 wherein the esterification catalyst is selected from the group consisting of p-toluene sulfonic acid, hypophosphorous acid, sulfuric acid, hydrochloric acid, phosphoric acid, acid-activated clays, solid acid catalysts, acidic zeolites, and combinations thereof.

9. The anti-wear compound of claim 1, wherein the anti-wear compound is made from a first moiety, second moiety and third moiety combination selected from the group consisting of: trimethylol propane trioleate-sorbic acid-sorbitol; trimethylol propane trioleate-sorbic acid-glycerol; and trimethylol propane trioleate-sorbic acid-hydroquinone.

10. A process for synthesizing an anti-wear compound, comprising:

(a) reacting an unsaturatedsynthetic base oil or an unsaturated synthetic dieneophilic base oil first moiety with a second moiety in a molar ratio of from about 1:2 to about 2:1 at a temperature of from about 220° C. to about 320° C. under an inert atmosphere to form an intermediate adduct in a Diels-Alder reaction, wherein the second moiety is a compound having a conjugated diene and a carboxylic acid or anhydride group; and (b) esterifying the intermediate adduct with a third moiety in a molar ratio of from about 1:2 to about 2:1, wherein the third moiety is a polyhydroxy compound.

11. The process for synthesizing an anti-wear compound of claim 10, wherein the unsaturated synthetic base oil or the unsaturated synthetic dieneophilic base oil is selected from the group consisting of unsaturated $C_{12}$-$C_{50}$ alkenes, $C_{12}$-$C_{50}$ dienes, unsaturated polyalphaolefins, unsaturated polyacrylates, unsaturated dehydrated polyol esters; unsaturated fatty esters having a branched or straight chain mono- or polyunsaturated $C_{10}$-$C_{24}$ fatty acid esterified to a $C_1$-$C_{24}$ straight or branched, saturated or unsaturated alcohol; unsaturated fatty polyol esters having a mono- or polyunsaturated $C_{10}$-$C_{24}$ branched or straight chain fatty acid esterified to one or more hydroxyl sites of a polyol selected from ethyleneglycol, polyethyleneglycol, propyleneglycol, polypropyleneglycol, polyethoxylated alcohols, trimethyloipropane, pentaerythritol, dimethyloipropane, dipentaerythritol, and trimethylolethane; cyclopentene, cyclopentadiene, cyclohexene, cyclohexadiene, 3-pyrroline; substituted benzene, substituted toluene, substituted xylene, substituted quinone, substituted naphthalene, substituted anthracene, substituted pyrrole, substituted furan, substituted thiophene, substituted pyridine, substituted pyrimidine, substituted imidazole, substituted thiazole; $X_1$-ester-linked benzoic acid, $X_1$-ester-linked benzyl, $X_1$-ester-linked naphthenic, $X_1$-ester-linked phenol; a branched or straight chain mono- or polyunsaturated $C_{10}$-$C_{24}$ fatty acid; and combinations thereof, wherein the substitution is a mono- or polyunsaturated $C_2$-$C_{25}$ branched or straight chain alkenyl, wherein $X_1$-ester-linked is $C_2$-$C_{24}$ straight or branched carboxylic acid side chains or a $C_1$-$C_{24}$ straight or branched, saturated or unsaturated alcohols.

12. The process for synthesizing an anti-wear compound of claim 10, wherein the second moiety is selected from a group consisting of sorbic acid, sorbic anhydride, salicylic acid, salicylic anhydride, $C_{1-10}$ alkyl, $C_{2-10}$ alkenyl, or $C_{1-10}$ alkoxy derivatives of the foregoing acids and anhydrides, and combinations thereof.

13. The process for synthesizing an anti-wear compound of claim 10 wherein the polyhydroxy compound of the third moiety is selected from the group consisting of glycerol, sorbitol, hydroxyquinone, glucose, mannose, 6-carbon sugars, pentose, fructose, 5-carbon sugars, pentaerythritol, catechol, resorcinol, hydroquinone, pyrogallol, 4,4'-dihydroxybiphenyl, 2,4-dihydroxybiphenyl, 2,2'-dihydroxybiphenyl, orthohydroxybenzene, polyhydroxyaromatic compounds having one or two phenyl rings and one or two 5-6 membered aromatic rings having substituted alkyl or alkenyl side chains ($C_{2-10}$) substituted with at least two hydroxyl groups, trimethylolpropane, dimethylolpropane, dipentaerythritol, trimethylolethane, ethyleneglycol, polypropyleneglycol, polyethoxylated alcohols, and combinations thereof.

14. The process for synthesizing an anti-wear compound of claim 10 wherein the first reaction is conducted under an inert atmosphere with full vacuum.

15. The process for synthesizing an anti-wear compound of claim 10 wherein the esterification reaction comprises reaction conditions of from about 150° C. to about 230° C. under an inert atmosphere and further comprises adding an esterification catalyst.

16. The process for synthesizing an anti-wear compound of claim 15 wherein the esterification catalyst is an acid catalyst.

17. The process for synthesizing an anti-wear compound of claim 16 wherein the esterification catalyst is selected from the group consisting of p-toluene sulfonic acid, hypophosphorous acid, sulfuric acid, hydrochloric acid, phosphoric acid, acid-activated clays, solid acid catalysts, acidic zeolites, and combinations thereof.

18. An anti-wear supplement composition for addition to lubricant formulas, comprising from about 1.0% to about 50% by weight of a non-phosphorous anti-wear compound, from about 0% to about 25% by weight of a phosphorous additive, from about 0% to about 10% of an extreme pressure additive, from about 0% to about 25% of a solubility stabilizer, and from about 25% to about 75% of a base oil carrier, wherein the non-phosphorous anti-wear compound comprises an intermediate adduct of a first moiety reacted in a first reaction with a second moiety to form the intermediate adduct and further esterifying the intermediate adduct with a third moiety in a molar ratio of from about 1:2 to about 2:1, wherein the first moiety is an unsaturated synthetic base oil or an unsaturated synthetic dieneophilic base oil, wherein the second moiety is a compound having a conjugated diene and a carboxylic acid or anhydride group, wherein the first reaction comprises mixing the first moiety with the second moiety in a molar ratio of from about 1:2 to about 2:1 at a temperature of from about 220° C. to about 320° C. under an inert atmosphere; and wherein the third moiety is a polyhydroxy compound.

19. The anti-wear supplement composition for addition to lubricant formulas of claim 18, wherein the unsaturated synthetic base oil or the unsaturated synthetic dieneophilic base oil is selected from the group consisting of unsaturated $C_{12}$-$C_{50}$ alkenes, $C_{12}$-$C_{50}$ dienes, unsaturated polyalphaolefins, unsaturated polyacrylates, unsaturated dehydrated polyol esters; unsaturated fatty esters having a branched or straight chain mono- or polyunsaturated $C_{10}$-$C_{24}$ fatty acid esterified to a $C_1$-$C_{24}$ straight or branched, saturated or unsaturated alcohol; unsaturated fatty polyol esters having a mono- or polyunsaturated $C_{10}$-$C_{24}$ branched or straight chain fatty acid esterified to one or more hydroxyl sites of a polyol selected from ethyleneglycol, polyethyleneglycol, propyleneglycol, polypropyleneglycol, polyethoxylated alcohols, trimethylolpropane, pentaerythritol, dimethylolpropane, dipentaerythritol, and trimethylolethane; cyclopentene, cyclopentadiene, cyclohexene, cyclohexadiene, 3-pyrroline; substituted benzene, substituted toluene, substituted xylene, substituted quinone, substituted naphthalene, substituted anthracene, substituted pyrrole, substituted furan, substituted thiophene, substituted pyridine, substituted pyrimidine, substituted imidazole, substituted thiazole; $X_1$-ester-linked benzoic acid, $X_1$-ester-linked benzyl, $X_1$-ester-linked naphthenic, $X_1$-ester-linked phenol; a branched or straight chain mono- or polyunsaturated $C_{10}$-$C_{24}$ fatty acid; and combinations thereof, wherein the substitution is a mono- or polyunsaturated $C_2$-$C_{25}$ branched or straight chain alkenyl, wherein $X_1$-ester-linked is $C_2$-$C_{24}$ straight or branched carboxylic acid side chains or a $C_1$-$C_{24}$ straight or branched, saturated or unsaturated alcohols.

20. The anti-wear supplement composition of claim 18, wherein the second moiety is selected from a group consisting of sorbic acid, sorbic anhydride, salicylic acid, salicylic anhydride, $C_1$-$C_{10}$ alkyl, $C_{2-10}$ alkenyl, or $C_{1-10}$ alkoxy derivatives of the foregoing acids and anhydrides, and combinations thereof.

21. The anti-wear supplement composition for addition to lubricant formulas of claim 18, wherein the polyhydroxy compound of the third moiety is selected from the group consisting of glycerol, sorbitol, hydroxyquinone, glucose, mannose, 6-carbon sugars, pentose, fructose, 5-carbon sugars, pentaerythritol, orthohydroxybenzene, polyhydroxyaromatic compounds having one or two phenyl rings and at least two hydroxyl groups, trimethylolpropane, polyethoxylated alcohols, and combinations thereof.

22. The anti-wear supplement composition for addition to lubricant formulas of claim 18, wherein the esterification reaction comprises reaction conditions of from about 150° C. to about 230° C. under an inert atmosphere and further comprises adding an esterification catalyst.

23. The anti-wear supplement composition for addition to lubricant formulas of claim 22, wherein the esterification catalyst is an acid catalyst.

24. The anti-wear supplement composition for addition to lubricant formulas of claim 23, wherein the esterification catalyst is selected from the group consisting of p-toluene sulfonic acid, hypophosphorous acid, sulfuric acid, hydrochloric acid, phosphoric acid, acid-activated clays, solid acid catalysts, acidic zeolites, and combinations thereof.

25. A crankcase oil formulation comprising from about 0.1% to about 10% of a non-phosphorous anti-wear compound, from about 0% to about 0.2% of a phosphorous additive, from about 0% to about 1% of an extreme pressure additive, from about 3% to about 10% of a viscosity index improver, from about 0.1% to about 1.0% of an anti-oxidant, from about 0.1% to about 1.0% of a pour point depressant, from about 2.0% to about 5.0% of a dispersant, from about 1.0% to about 5.0% of a detergent, and from about 80% to about 95% of a base oil carrier, wherein the non-phosphorous anti-wear compound comprises an intermediate adduct of a first moiety reacted in a first reaction with a second moiety to form the intermediate adduct and further esterifying the intermediate adduct with a third moiety in a molar ratio of from about 1:2 to about 2:1, wherein the first moiety is an unsaturated synthetic base oil or an unsaturated synthetic dieneophilic base oil, wherein the second moiety is a compound having a conjugated diene and a carboxylic acid or anhydride group, wherein the first reaction comprises mixing the first moiety with the second moiety in a molar ratio of from about 1:2 to about 2:1 at a temperature of from about 220° C. to about 320° C. under an inert atmosphere; and wherein the third moiety is a polyhydroxy compound.

26. The crankcase oil formulation of claim 25, wherein the unsaturated synthetic base oil or the unsaturated synthetic dieneophilic base oil-is selected from the group consisting of unsaturated $C_{12}$-$C_{50}$ alkenes, $C_{12}$-$C_{50}$ dienes, unsaturated polyalphaolefins, unsaturated polyacrylates, unsaturated dehydrated polyol esters; unsaturated fatty esters having a branched or straight chain mono- or polyunsaturated fatty acid esterified to a $C_1$-$C_{24}$ straight or branched, saturated or unsaturated alcohol; unsaturated fatty polyol esters having a mono- or polyunsaturated $C_{10}$-$C_{24}$ branched or straight chain fatty acid esterified to one or more hydroxyl sites of a polyol selected from ethyleneglycol, polyethyleneglycol, propyleneglycol, polypropyleneglycol, polyethoxylated alcohols, trimethylolpropane, pentaerythritol, dimethylolpropane, dipentaerythritol, and trimethylolethane; cyclopentene, cyclopentadiene, cyclohexene, cyclohexadiene, 3-pyrroline; substituted benzene, substituted toluene, substituted xylene, substituted quinone, substituted naphthalene, substituted anthracene, substituted pyrrole, substituted furan, substituted thiophene, substituted pyridine, substituted pyrimidine, substituted imidazole, substituted thiazole; $X_1$-ester-linked benzoic acid, $X_1$-ester-linked benzyl, $X_1$-ester-linked naphthenic, $X_1$-ester-linked phenol; a branched or straight chain mono- or polyunsaturated $C_{10}$-$C_{24}$ fatty acid; and combinations thereof, wherein the substitution is a mono- or polyunsaturated $C_2$-$C_{25}$ branched or straight chain alkenyl, wherein $X_1$-ester-linked is $C_2$-$C_{24}$ straight or branched carboxylic acid side chains or a $C_1$-$C_{24}$ straight or branched, saturated or unsaturated alcohols.

27. The crankcase oil formulation of claim 25 wherein the second moiety is selected from a group consisting of sorbic acid, sorbic anhydride, salicylic acid, salicylic anhydride, $C_1$-$C_{10}$ alkyl, $C_{2-10}$ alkenyl, or $C_{1-10}$ alkoxy derivatives of the foregoing acids and anhydrides, and combinations thereof.

28. The crankcase oil formulation of claim 25 wherein the polyhydroxy compound of the third moiety is selected from the group consisting of glycerol, sorbitol, hydroxyquinone, glucose, mannose, 6-carbon sugars, pentose, fructose, 5-carbon sugars, pentaerythritol, orthohydroxybenzene, polyhydroxyaromatic compounds having one or two phenyl rings and at least two hydroxyl groups, trimethyloipropane, polyethoxylated alcohols, and combinations thereof.

29. The crankcase oil formulation of claim 25 wherein the esterification reaction comprises reaction conditions of from about 150° C. to about 230° C. under an inert atmosphere and further comprises adding an esterification catalyst.

30. The crankcase oil formulation of claim 29 wherein the esterification catalyst is an acid catalyst.

31. The crankcase oil formulation of claim 30 wherein the esterification catalyst is selected from the group consisting of p-toluene sulfonic acid, hypophosphorous acid, sulfuric acid, hydrochloric acid, phosphoric acid, acid-activated clays, solid acid catalysts, acidic zeolites, and combinations thereof.

32. The anti-wear compound of claim 9, wherein the first moiety, second moiety, and third moiety combination is trimethylol propane trioleate, sorbic acid, and sorbitol, respectively.

* * * * *